United States Patent [19]

Larson

[11] Patent Number: 4,604,792

[45] Date of Patent: Aug. 12, 1986

[54] METHOD FOR MAKING ELECTRO-ACOUSTIC TRANSDUCER APPARATUS

[75] Inventor: David A. Larson, Downers Grove, Ill.

[73] Assignee: LFF & Associates, San Diego, Calif.

[21] Appl. No.: 684,379

[22] Filed: Dec. 20, 1984

[51] Int. Cl.[4] ..... H04R 31/00

[52] U.S. Cl. ..... 29/594; 179/115.5 R; 179/115.5 ES; 179/115.5 PV; 179/181 R; 181/173; 264/287; 425/303; 425/396

[58] Field of Search ..... 29/594, 602 R, 606; 179/115.5 PV, 115.5 ES, 115.5 R, 115 R, 117, 119 R, 181 R; 181/167, 172–174; 264/235, 285–287; 425/302.1, 303, 394, 396, 400

[56] References Cited

U.S. PATENT DOCUMENTS

| | | | |
|---|---|---|---|
| 2,624,390 | 1/1953 | Groat | 156/210 X |
| 3,171,904 | 3/1965 | Poutot | 179/115.5 |
| 3,290,205 | 12/1966 | Goldstein et al. . | |
| 3,575,768 | 4/1971 | Hannum | 156/459 X |
| 3,682,747 | 8/1972 | Munters | 156/459 |
| 4,037,061 | 7/1977 | von Reckinghausen | 179/115.5 PV |
| 4,227,952 | 10/1980 | Sabee | 156/164 |
| 4,251,311 | 2/1981 | Lemelson | 156/380 |
| 4,276,449 | 6/1981 | Sawafujl | 179/115.5 PV |

FOREIGN PATENT DOCUMENTS

| | | |
|---|---|---|
| 887973 | 4/1981 | Belgium . |
| 482132 | 8/1929 | Fed. Rep. of Germany . |

*Primary Examiner*—Carl E. Hall

*Attorney, Agent, or Firm*—Bernard L. Kleinke

[57] ABSTRACT

The method of making the diaphragm includes pressing on the front face of a film at spaced apart areas to deform it progressively into a series of closely-spaced generally U-shaped projections. A manufacturing device presses the sides of the projections inwardly to rigidify them. The transducer magnet assembly includes a series of elongated magnet pole-piece strips which confine magnets and are arranged in parallel spaced-apart rows with the ends thereof fitted into transverse elongated grooves extending within a pair of elongated cross-piece end members. The driver is fixed together in a precise manner by flowing an adhesive material into the grooves, and then by allowing such material to harden.

7 Claims, 14 Drawing Figures

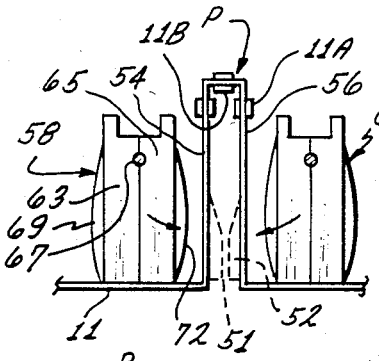
FIG. 4
FIG. 5
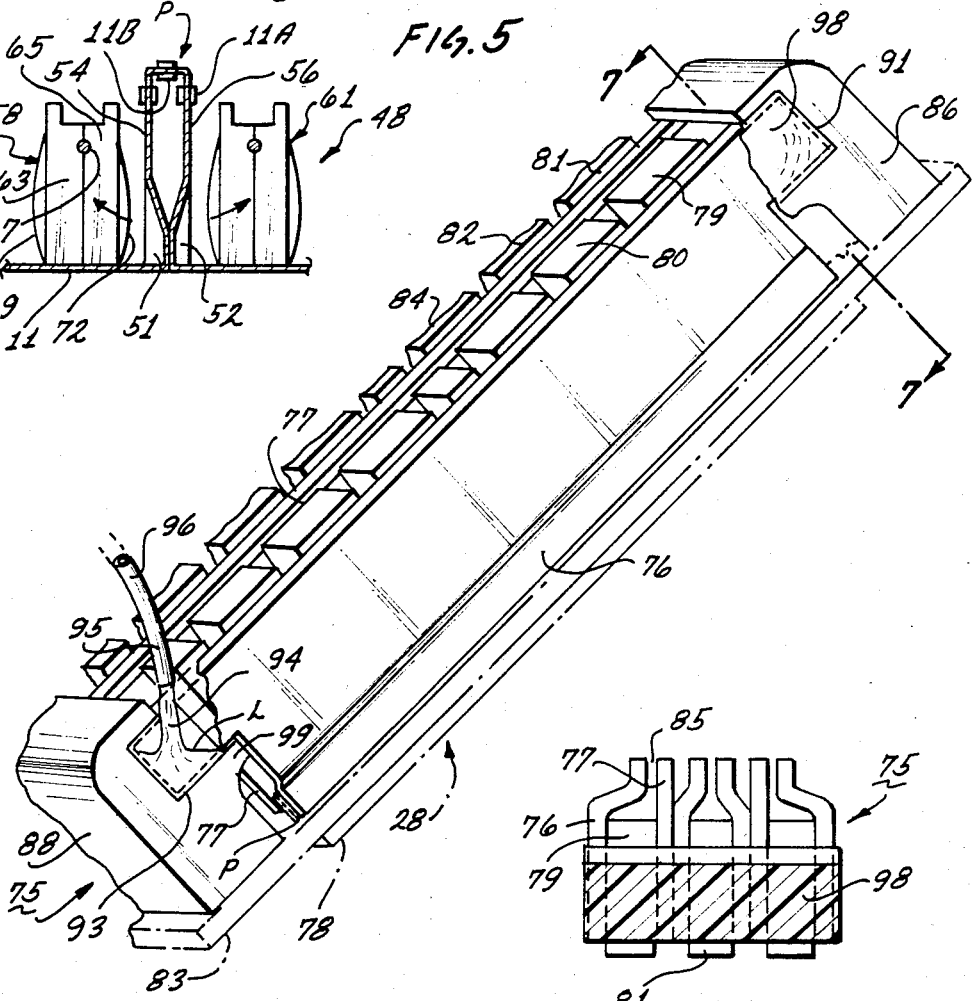
FIG. 6
FIG. 7

104
107
109
115
116
134
124
129
136
112
132
121
113
131
119
117
101
100
103
105

METHOD FOR MAKING ELECTRO-ACOUSTIC TRANSDUCER APPARATUS

DESCRIPTION

1. Technical Field

The present invention relates in general to a method and devices for making electro-acoustic transducer apparatus, and it more particularly relates to such a method and devices to facilitate modern, high-speed mass production of electro-acoustic transducer apparatus having a substantially flat, planar diaphragm.

2. Background Art

In both co-pending U.S. Patents, Ser. No. 389,423 filed June 17, 1982, now U.S. Pat. No. 4,491,698, and Ser. No. 503,947, filed Oct. 13, 1983, there is disclosed a new and improved electro-acoustic transducer having a generally flat or planar face composed of a film material configured with a series of spaced-apart projections bearing magnet means. It would be highly desirable to have a process and manufacturing devices for constructing such diaphragms from film material according to modern high speed production techniques. In this regard, such a process should be capable of producing on a continuous basis, the diaphragms in a highly effective, reliable and efficient manner.

The resulting transducer diaphragms include a series of very closely spaced projections bearing magnetic means for co-acting electro-acoustically with a transducer diaphragm magnet assembly. The projections must fit in substantially perfect registry within a series of closely-spaced gaps or openings of the magnet structure of the driver, to move freely therewithin. The resulting projections must be made in a precise, equally spaced apart manner, and yet be produced at a high rate of speed according to modern mass production techniques. If they should be made in anything less than a highly accurate manner, the resulting projections would not properly register within, and extend into the closely spaced magnet structure of the transducer driver, and move freely therewithin in an uninhibited operation.

Additionally, it would be highly desirable to have a method of making a new and improved transducer driver, which can be precisely and accurately made to accommodate the projections of the aforesaid diaphragm. Such a new driver must also be made according to modern, efficient production techniques

DISCLOSURE OF INVENTION

Therefore, it is the principal object of the present invention to provide a new and improved method and manufacturing devices for making a transducer apparatus according to modern high speed manufacturing techniques.

Another object of the present invention is to provide such a new and improved transducer diaphragm driver and a method of manufacturing it, in an efficient and effective manner.

Briefly, in accordance with the present invention, the above and further objects and features of the present invention are realized by providing a method and manufacturing devices for making an electro-acoustic transducer apparatus according to an efficient and reliable manufacturing process.

The method of making the diaphragm includes pressing on the front face of a film at spaced apart areas to deform it progressively into a series of closely-spaced generally U-shaped projections. A manufacturing device presses the sides of the projections inwardly to rigidify them. The transducer magnet assembly includes a series of elongated magnet pole-piece strips which confine magnets and are arranged in parallel spaced-apart rows with the ends thereof fitted into transverse elongated grooves extending within a pair of elongated cross-piece end members. The driver is fixed together in a precise manner by flowing an adhesive material into the grooves, and then by allowing such material to harden.

The method of making the transducers allows them to be produced continuously at a suitable production rate, and yet maintain precise tolerances, relative to both spacing of the projections on the diaphragm and the thickness dimension of the projections. Similarly, the method of making the magnet assembly enables the intervals between the gaps formed by the pole piece strips to be maintained precisely in a highly reliable and efficient manner.

BRIEF DESCRIPTION OF DRAWINGS

The above-mentioned and other objects and features of this invention and the manner of attaining them will become apparent, and the invention itself will be best understood by reference to the following description of embodiments of the invention taken in conjunction with the accompanying drawings, wherein:

FIG. 4 is an elevational view of a diaphragm projection being acted upon by a pinch forming manufacturing device constructed according to the present invention;

FIG. 5 is an elevational, sectional reduced-scale view of a diaphragm projection after the side rigidifying pinches are formed therein;

FIG. 6 is a pictorial, fragmentary view of a transducer driver in the process of being assembled according to the method of the present invention;

FIG. 7 is a sectional elevation view of the driver of FIG. 6, shown in a reduced scale, in the completed state;

FIG. 8A is a similar view of the device of FIG. 8, illustrating it in a fully open position in preparation for the projection forming operation;

BEST MODE FOR CARRYING OUT THE INVENTION

Figure 1:
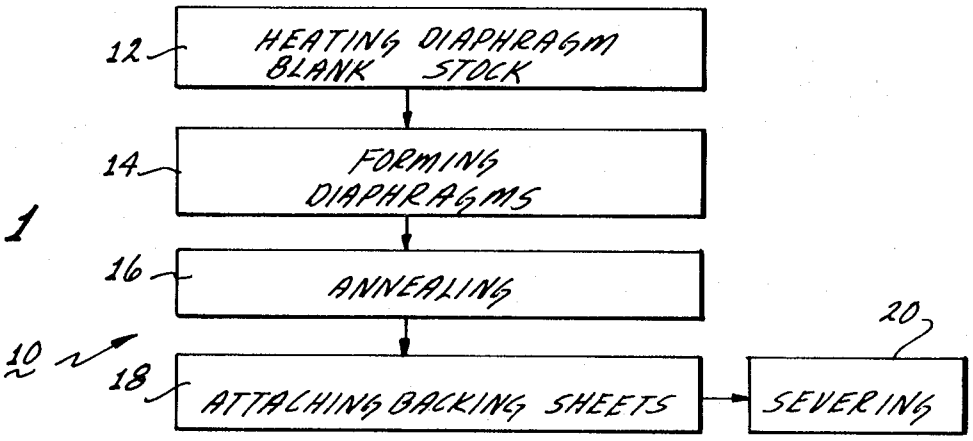
FIG. 1 is a flow chart diagram illustrating the method of making a transducer diaphragm according to the present invention.
Figure 3:
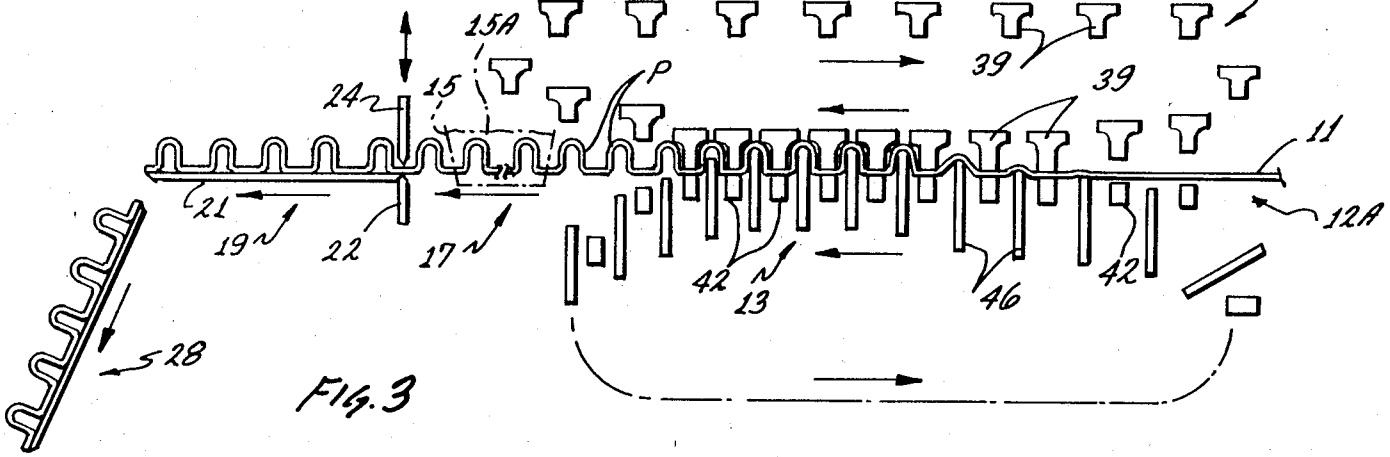
FIG. 3 is a schematic view of an elevational view of the manufacturing devices used according to the method illustrated in FIG. 1.
Figure 2:
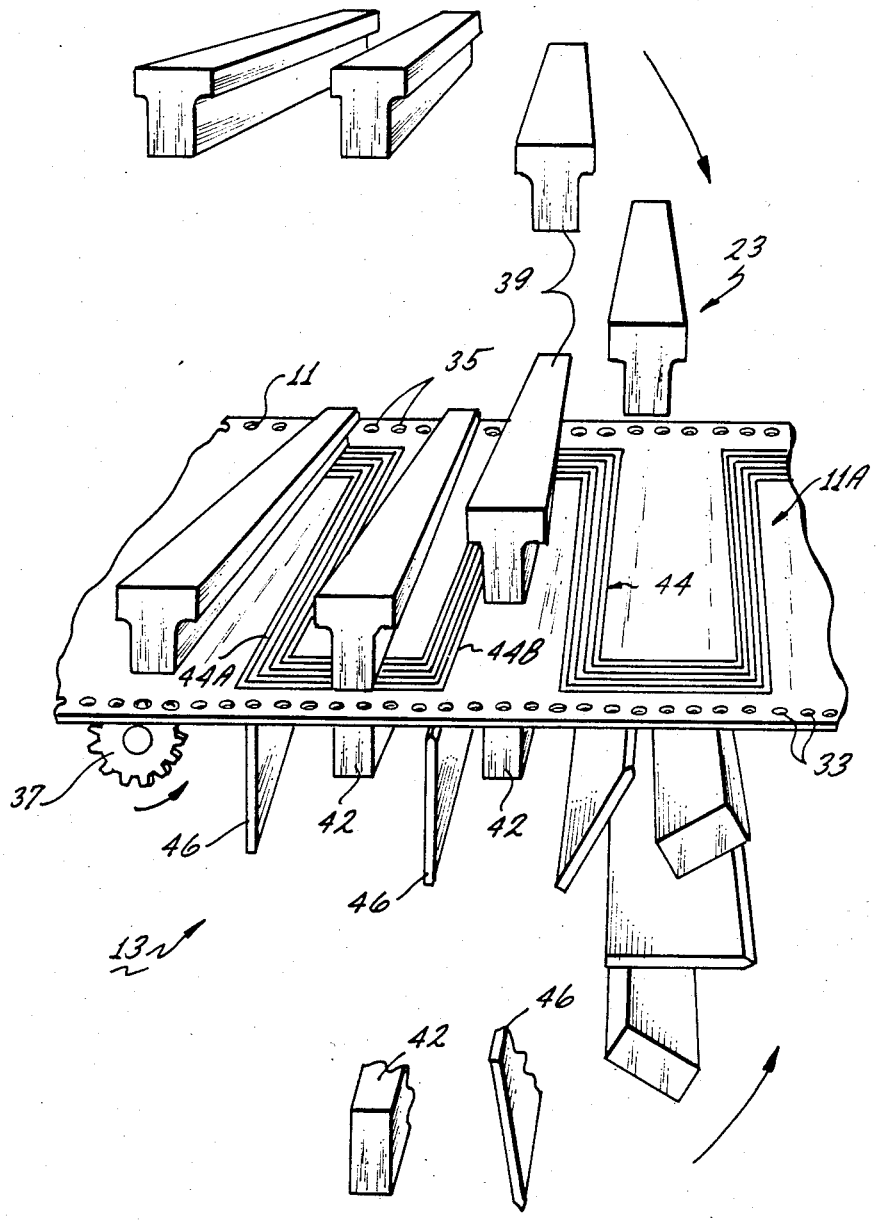
FIG. 2 is a partially schematic, fragmentary perspective view of the projection forming device used according to the method illustrated in FIG. 1, and constructed according to the present invention.

Referring now to the drawings, and more particularly to FIGS. 1–3, there is shown a flow diagram of a manufacturing method 10, which is carried out according to the present invention, for making electro-acoustic transducer diaphragms, such as the diaphragm shown schematically in FIG. 3. The diaphragms are described more fully in the aforementioned co-pending U.S. patent applications.

The diaphragms are formed from a blank stock 11 composed of suitable thermoformable film material, such as the materials disclosed in the aforementioned patent applications. The continuous web of blank stock 11 has disposed thereon a series of individual conductors 11A (FIG. 2) and 11B (FIGS. 4 and 5) on opposite sides thereof. The conductors are deposited on the film blank stock 11 according to conventional printed circuit techniques. The arrangement and placement of the conductors is described in greater detail in the aforementioned co-pending patent applications.

As indicated in FIG. 1, and as shown in FIGS. 2 and 3, the blank stock 11 is moved continuously along a horizontal path of travel, and is heated, as indicated at 12 (FIG. 1) at a heating station 12A (FIG. 3). After heating the blank stock to a suitable temperature, the blank stock is moved to a projection forming station generally indicated at 13 (FIG. 3), where a series of closely spaced, parallel, generally U-shaped projections P, are formed by means of a projection forming manufacturing device 23 with the conductor patterns positioned at both the inside and the outside of the tip portions thereof. As indicated in FIG. 1 at 14, the projections P are formed transversely to the patch of travel of the blank stock 11, according to a continuous mode of operation.

As indicated at 16 in FIG. 1, the next step in the process is to anneal the formed blank stock 11 at an annealing station 17 as shown in FIG. 3. An annealing tank 15 contains a glycerine bath 15A which heats the formed blank 11 to a suitable annealing temperature. Thereafter, the annealed blank is cooled.

According to an attaching step 18 as indicated in FIG. 1, at an attaching station 19 as shown in FIG. 3, a rigid backing sheet 21 is then affixed to the front of the annealed and formed blank stock, by any suitable technique, such as the application of a suitable adhesive, solvent, or by heat welding or the like. In this manner, the rigid backing sheet 21 is affixed to the flat front (lower) surface of the formed blank stock to rigidify it, for maintaining the projections P substantially perpendicular to the flat backing sheet 21.

Once the backing sheet is attached, the next step is to sever the completed diaphragm from the blank as indicated at 20 in FIG. 1. In this regard, a lower knife blade 22 co-acts with an upper reciprocating knife blade 24 to sever the formed portion of the stock from the remaining portion thereof. It will become apparent to those skilled in the art that other suitable cutting techniques may also be employed.

As a result, a completed diaphragm such as the diaphragm 28 is separated from the main body of the stock.

Referring now to FIG. 2, the film blank stock 11 includes a series of equally spaced-apart sprocket holes 33 arranged along one marginal edge thereof extending in the path of the stock. A series of equally spaced-apart sprocket holes 35 are aligned along the opposite marginal edge thereof, whereby a pair of sprockets, such as the sprocket 37 engaging the holes 33, drive the blank stock 11 along a horizontal path as indicated in FIG. 2.

As shown in FIG. 2, at the projection forming station 13, the device 23 includes a series of elongated spaced-apart transversely extending clamping bars 39 are moved continuously through a closed-loop path for continuously engaging the upper surface of the blank stock 11 as it moves horizontally from right to left, as viewed in FIG. 2 of the drawings. The upper bars 39 move continuously through a closed-loop path of travel in a clockwise direction as viewed in FIG. 1.

Similarly, a series of lower elongated spaced-apart transversely extending clamping bars 42 move through a closed loop path in a counter-clockwise direction to engage the underside of the blank stock 11 as it moves leftwardly in FIG. 2 of the drawings. The upper and lower clamping bars engage the film stock on opposite faces thereof directly opposite one another.

The upper bars 39 engage the areas of the blank stock 11 midway between pairs of groups of transversely extending conductors, such as the conductors 44A and 44B. Similarly, like corresponding ones of the lower bars 42 engages the lower face of the blank stock 11 in positions directly opposite corresponding ones of the upper bar 39 and in synchronism therewith, to clamp the stock 11 in spaced-apart positions as indicated in FIGS. 2 and 3 of the drawings, as the stock continues to move leftwardly .

A series of spaced-apart knife blades 46 move with the lower bars 42 are interweaved therewith. In this manner, once the upper and lower clamping bars 39 and 42 engage opposite surfaces of the blank stock 11, the knife blades 46 move through a continuous closed-loop counter-clockwise path of travel and engage the lower face of the stock 11 in alignment with the transversely extending groups of conductors, such as the conductors 44B on the upper surface, to push upwardly on the moving blank to form the projections P as shown in FIG. 3 of the drawings.

In order to facilitate the formation of the projections P, the upper and lower pairs of clamping bars 39 and 42 move simultaneously toward one another to allow the lower knife blade 46 to urge the blank upwardly between the converging upper bars 39. As indicated in FIG. 3, the upper bars 39 are generally T-shaped in cross-section throughout their longitudinal lengths, and as pairs of the bars 39 move into close proximity to one another, they assume complimentary-shaped recesses for receiving the formed projections therebetween. The lower bars are generally rectangular in cross-section throughout their lengths, and the knife blades 46 each has an upper rounded or otherwise contoured upper edge to form the inner surface of the tip portion of the projections P. The outer surface of the tip portions are moved into engagement with the upper portions of the T-shaped pairs of clamping bars 39 to serve as a backing member to cooperate with the upwardly moving knife blades.

As shown in FIG. 3 of the drawings, once the knife blades 46 push sufficiently upwardly to form the projections P, they then remain in position during the heat treating step of the process.

After heat treating and cooling, the knife blades 46 retract downwardly away from the blank stock 11. Also, in synchronism therewith, the lower clamping bars 46 also move farther apart as they travel through their closed-loop path downwardly away from the stock 11 in the counter-clockwise path of travel to enable the cycle of operation to be repeated continuously.

Similarly, as the lower clamping bars 42 move away from the lower face of the blank stock 11, the upper clamping bars 39 move upwardly away from the upper surface of the blank through their clockwise path of travel and then back to repeat the cycle of operation. As they move away from the blank, the bars 39 move apart to return to their original spacing in preparation for their downward decent onto the blank as described previously.

Suitable control mechanisms (not shown) are provided to maintain the continuous synchronous movement of the clamping bars and knife blades, relative to the continuously moving blank stock.

Referring now to FIGS. 4 and 5 of the drawings, there is shown a pinch forming manufacturing device generally indicated at 48 for providing the projections, such as the projection P of FIG. 4 with a pair of inwardly extending pinches or gussets 51 and 52 in a pair of parallel transversely extending legs 54 and 56 to rigidify them. In this regard, the two pinches or gussets 51 and 52, as shown in FIG. 5, cause the legs 54 and 56, to be fused together in selected spaced-apart areas as more fully described in the foregoing mentioned patent applications, to help maintain them in a perpendicular configuration, relative to the backing sheet to be attached to the formed sheet. In this manner, the projection P remains in a perpendicular configuration relative to the backing sheet, as explained more fully in the aforementioned co-pending patent applications.

The manufacturing device 48 comprises a pair of pinch forming units 58 and 61 disposed on opposite sides of the projection P. The units 58 and 61 are generally similar to one another, and therefore only the unit 58 will be described in greater detail.

It should be understood that pairs of like units (not shown) are positioned on each side of each projection, so that the multiple pinches are formed in each one of the projections. Similar pinch forming devices (not shown) are positioned along the path of travel of the blank at a suitable position (not shown) between the forming position 13, and the annealing position 17 to provide each one of the projections with the desired pinches.

The unit 58 generally includes a pair of elongated by members 63 and 65 which are pivotally attached at their upper ends at 67 to swing apart into engagement with adjacent projections.

A pair of bulbous parts 69 and 72 project outwardly from the lower portions of the respective members 63 and 65. The bulbous part 72 swings rightwardly in the direction of the arrow into engagement with the left leg 54 to form the pinch 51. The part 69 swings simultaneously leftwardly into engagement with a right leg (not shown) of an adjacent projection (not shown), to form a pinch therein.

The units 58 and 61 are heated to facilitate the deformation of the legs of the projections to readily deform inwardly and to fuse them together. The parallel extending legs of each projection thus are deformed at selected locations inwardly until they engage one another and fuse together. In this manner, the legs are, at selected spaced-apart areas, then locked together to rigidify the structure of the projection P relative to the backing sheet. In this regard, once the blank stock 11 is then moved through the hot glycerine bath 15 (FIG. 3). The heated pinched portions are then cooled to form a rigid configuration.

Referring now to FIGS. 6 and 7 of the drawings, there is shown an electro-acoustic transducer magnet assembly 75, which is constructed according to the present invention, and which is adapted to interact electro-magnetically with a transducer diaphragm made by the process of FIG. 1. As shown in broken lines in FIG. 6, a diaphragm 78, constructed according to the method of the present invention, is suspended within an opening (not shown) in a front driver frame as shown in broken lines at 83, for attachment to a suitable speaker enclosure (not shown).

The projections, such as the projection P of the diaphragm 78, fit within spaces, such as the space or gap 85 shown in FIG. 7, between a series of parallel, spaced-apart elongated steel pole piece strips, such as the strips 76 and 77. A series of permanent magnets, such as the permanent magnets 79–82 (FIG. 6), are disposed or sandwiched tightly between the pole piece strips. In this regard, the permanent magnets are in the form of blocks, and are arranged in a spaced-apart manner, between a pair of pole piece strips, such as the magnets 79 and 80 positioned between the adjacent strips 76 and 77.

A pair of complementary-shaped elongated end bars 86 and 88 each include oppositely-disposed elongated grooves 91 and 93 for receiving the ends of the pole piece strips. As shown in FIG. 6, a block 98 composed of hardened epoxy material fills the grove 91 in the end bar 86 to fix the ends of the pole piece strips in place in a critically-aligned spaced-apart manner, to the end bar 86 in a perpendicular configuration relative thereto.

Considering now the method of construction of the magnet assembly unit in accordance with the present invention, as shown in FIG. 6, the pole piece strips and magnets are critically-aligned in the desired position and are held in place within the end bars, by suitable means (not shown), such as fixtures and/or adhesives. Thereafter, the entire assembly is raised into an upright attitude at a position of about 45 degrees relative to the horizontal.

Once the unit is disposed as shown in FIG. 6, epoxy is deposited via supply tube 96 which has its exit end 95 disposed slightly above the groove 93 in the end bar 88. It will become apparent to those skilled in the art that other techniques may also be used for supplying epoxy to the grooves.

In this regard, with the assembly disposed in the attitude as shown, the groove 93 is opened upwardly. Once in place, the epoxy material 94 is delivered to the elongated groove 93. In this manner, the material 94 flows into the groove 93 to fill it and, thus to imbed or flow around the lower ends of the strips in the epoxy material. The material 94 is then allowed to harden to form an epoxy block, which is similar to the block 98.

In order to receive an adequate quantity of epoxy material to rigidly secure and imbed the strip ends, the end bars, such as the end bar 88, includes an inwardly extending projection or lip, such as the projection 99, defining the lower portion of the groove 93 of the bar 88. In this manner, when the unit is disposed in the approximate 45 degree attitude as shown, the level L (FIG. 6) can rise sufficiently high to cover over and imbed the strip ends in proper position.

Since the elongated grooves are provided in the end bars, the pole piece strip ends need not fit precisely therewithin—only a loose tolerance fit is required. Thus, only gross tolerances need be observed, and hence the cost of manufacturing the driver assembly is reduced, as compared to the situation where a close fitting tolerance would otherwise be required.

Also, should subsequent design modifications require different sizes or shapes of pole piece strips, the same end bars can be employed. For example, if thicker or thinner strips are required for a certain application, the same end bars may still be employed for such application.

After reviewing the foregoing, it will become apparent to those skilled in the art that, in place of an elongated groove, a series of wide grooves (not shown) may be provided for individually and loosely receiving the ends of the strips. Each such wide groove would be substantially wider than the thickness of the strips, and in this manner, a smaller quantity of epoxy would be employed.

Figure 8:
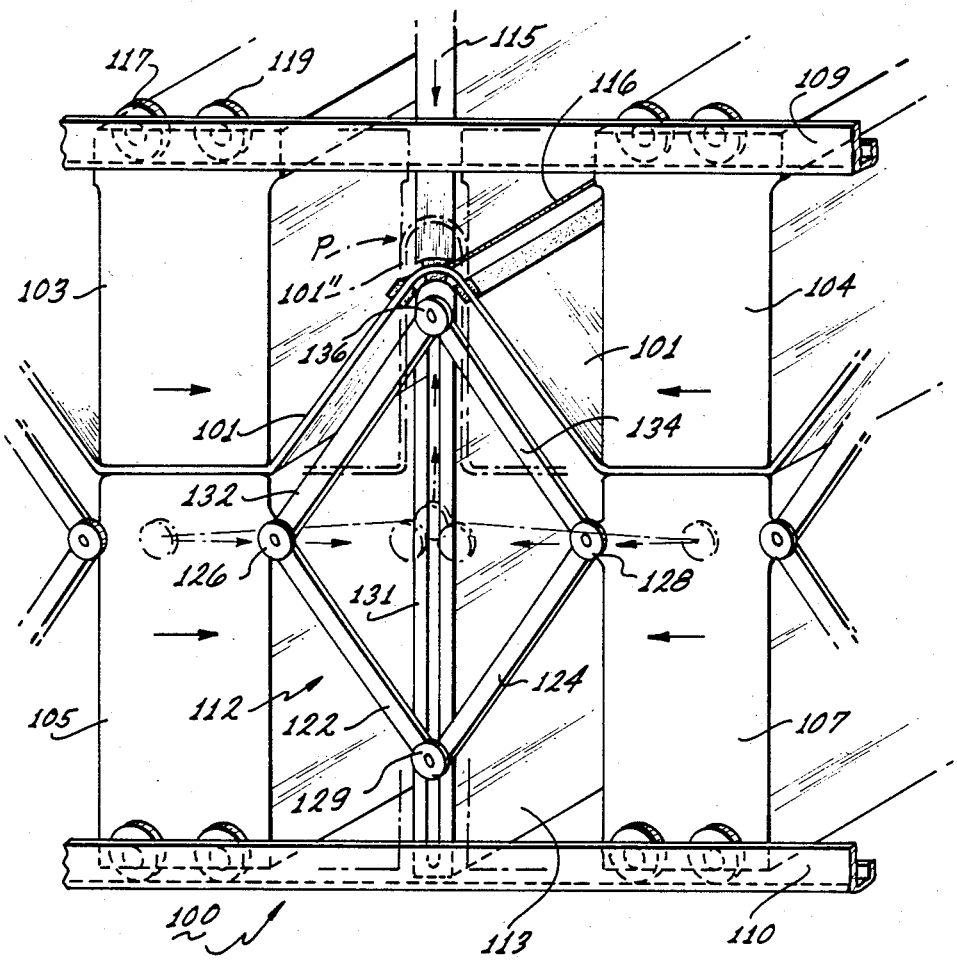
FIG. 8 is a fragmentary, pictorial view of another projection forming device used according to the method illustrated in FIG. 1, and constructed according to the present invention, the device being illustrated in an intermediate closed position.
Figure 8B:
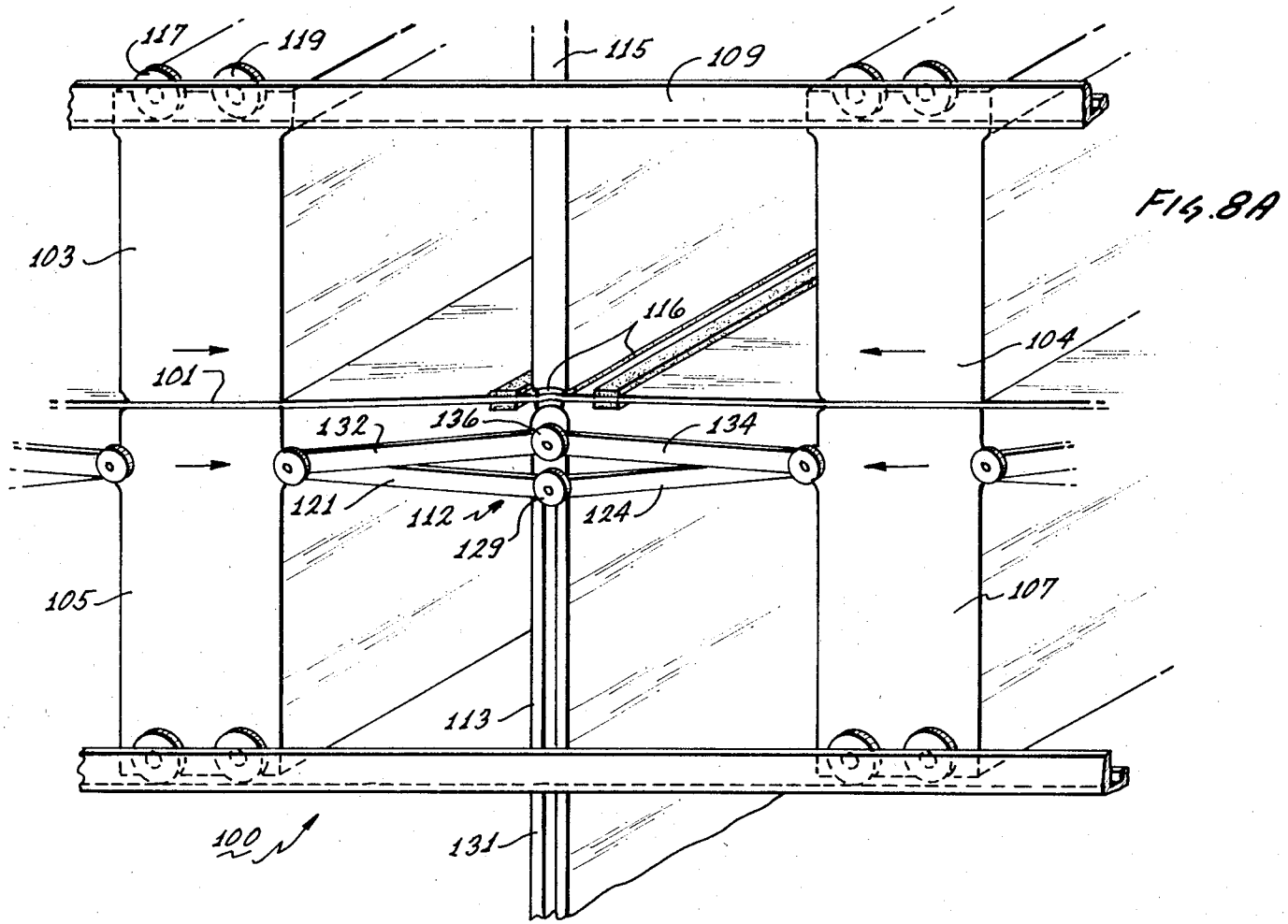
FIG. 8B is a similar view of the device of FIG. 8, illustrating it in a fully closed position at the completion of the projection forming operation.
Figure 8B:
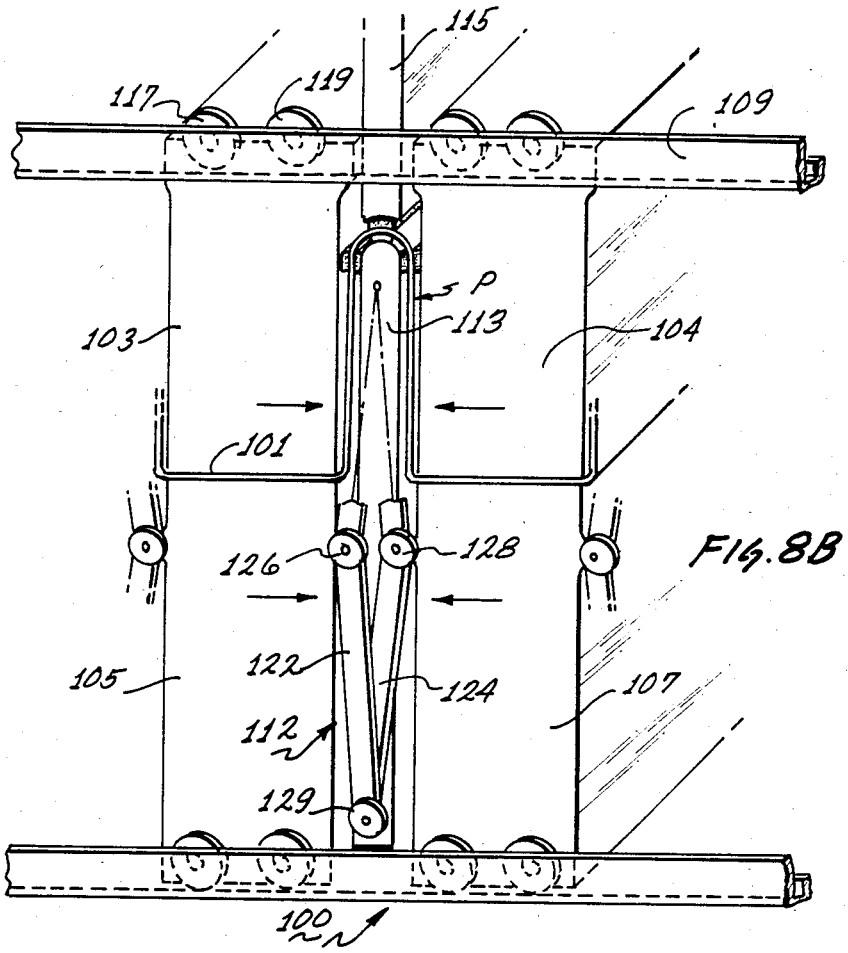

Referring now to FIG. 8, 8A, 8B and 8C, there is shown another diaphragm projection forming manufacturing device 100, which is also constructed according to the present invention, and which forms a series of projections, such as the projection P shown in solid lines in FIG. 8B and in broken lines in FIG. 8, which illustrates the projection in the process of being formed, from a sheet 101 of blank stock composed of similar film material as the blank stock of FIGS. 2 and 3. The device 100 can be used in place of the device 23 of FIG. 2 and 3, to form the diaphragm projections according to the method of FIG. 1.

The device 100 generally comprises a series of pairs of parallel, spaced-apart upper clamping bars, such as the upper clamping bars 103 and 104, for engaging with their bottom surfaces the upper surface of the blank stock material when it is disposed in an initial flat, substantially horizontal disposition, as indicated in FIG. 8A, which shows the device 100 in preparation for the formation of the projection P. Similarly, a series of pairs of parallel, spaced-apart lower clamping bars, such as the lower clamping bars 105 and 107, engage the blank stock 101 on its bottom surface and directly below the upper bars to press the stock tightly and releasably therebetween.

In order to mount the clamping bars in a transversely moveable manner, each one of the upper clamping bars is rollably suspended from an upper track 109. Likewise, each one of the lower clamping bars is rollably mounted from below in a lower track 110. In this manner, the clamping bars are adapted to slide toward one another during the projection forming process, as indicated by the arrows in FIG. 8.

A control linkage 112 is pivotally attached to a vertically disposed knife bar 113, which is disposed midway between the pair of clamping bars. The knife is positioned below the stock 101 to push upwardly on it from below, to form the projection P. It should be understood that there is a similar control linkage (not shown) pivotally mounted on the opposite end of the knife bar 113, and pivotally attached to the other ends of the clamping bars 105 and 107 in a similar manner as the linkage 112.

The control linkages, such as the linkage 112 causes the knife bar 113 to be maintained in the proper centrally-disposed position relative to the clamping bars, during the projection forming operation.

An upper backing bar 115 is vertically reciprocatively mounted above the blank 101 directly opposite the knife bar 113. The function of the backing bar 115 is to cause the uppermost conductor 116 to be crimped or creased during the projection forming operation. In this regard, as the knife blade 113 pushes upwardly on the blank 101, it is first moved into firm engagement with the concave groove on the bottom edge of the upper backing bar 115, which subsequently retracts in unison with the upward movement of the knife blade.

Figure 8C:
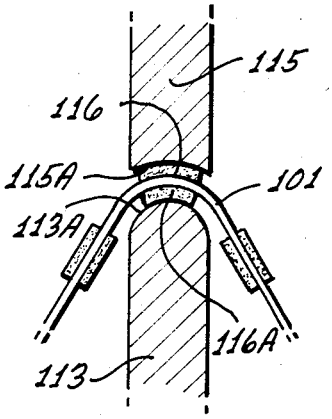
FIG. 8C is an enlarged detail view of the tip portion of a projection being formed, shown in FIG. 8.

In so doing, as best seen in FIG. 8C, conductors 116 and 116A on opposite sides of the tip portion of the projection P, the conductors 116 and 116A become crimped or creased simultaneously, since they are composed of a thin, soft metal, such as aluminum. In this manner, the conductors 116 and 116A do not tend to de-laminate from the blank 101, which becomes formed by action of the lower knife blade 113, and the backing bar as a result of the operation of the device 100.

In order to facilitate the crimping operation, the upper edge 113A is rounded and engages the inner conductor 116A. Similarly, the bottom edge 115A of the bar 115 engages the outer conductor 116.

Thus, the device 100 forms transversely extending projections in the stock in a similar manner as device 23. However, the device 100 can be used on cut sheets of the stock, instead of a continuous web of stock as shown in FIGS. 2 and 3 for use with the device 23. In this regard, the diaphragms can be formed by the device 100, either singly, or in multiple numbers that can be subsequently severed apart.

In operation, the sheet of the blank 101 is first clamped securely between the pairs of upper and lower clamping bars, which move through a rectilinear path of travel toward the blank. It is understood that there are other such pairs of clamping bars (not shown), each being aligned as described in connection with the device 23.

Thereafter, the pairs of opposed clamping bars move together in unison with and in synchronism with the upwardly moving knife bar 113 to form the projection P.

Just prior to the converging sideward movement of the pairs of bars, the backing bar 115 and the knife bar 113 move rectilinearly toward one another to clamp the conductors 116 and 116A and the blank therebetween. Thereafter, the knife bar is then moved upwardly forcibly by means (not shown) to push the backing bar upwardly and, at the same time, pull the clamping bars together by means of the linkage 112. In this manner, the projection P is formed as shown in FIG. 8B, and the conductors 116 and 116A are crimped longitudinally simultaneously therewith. In this manner, the projections are formed in a gentle, non-abrasive manner to avoid damaging the conductors.

It should be noted that the upper clamping bars 103 and 104 are generally T-shaped in a similar manner as the upper bars of the device of FIG. 1, to form a complementary shaped recess for the projection P, when the blank is disposed as indicated in broken lines at 101. The bars 103 and 104 do not come into contact with one another in their closed position, because the knife bar and the blank are disposed therebetween.

After the projection P is formed, the pair of opposed clamping bars are retracted away from the blank to permit the formed blank to be removed from the device 100, and thereafter to be reset.

In order to support the clamping bars rollably on the tracks 109 and 110, each block includes a pair of wheels or rollers, such as the wheels 117 and 119, on the bar 103. In this manner, the blocks are rollably supported by the tracks.

Considering now the control linkage in greater detail with reference to FIG. 8, the linkage 112 generally comprises a pair of lower links 122 and 124, which are attached pivotally at their upper ends to the respective pivot points 126 and 128 on their respective bars 105 and 107. The lower ends of the links 122 and 124 are pivotally connected together at a reciprocatively rectilinearly slideable pivot point 129, along a vertically disposed elongated slot or groove 131 in one side edge of the knife bar 113.

A pair of upper links 132 and 134 are pivotally attached at their lower ends to the respective pivot points 126 and 128. The upper ends of the links 132 and 134 are pivotally attached together at an upper pivot point 136, which is fixed to the upper end portion of the knife blade 113 vertically above the lower slideable pivot point 129.

It will become apparent to those skilled in the art that the orientation of the components of the device 100, can be varied. For example, the knife bar can be oriented above the blank and press downwardly on it, against the backing bar, which would be disposed below the blank.

Figure 11:
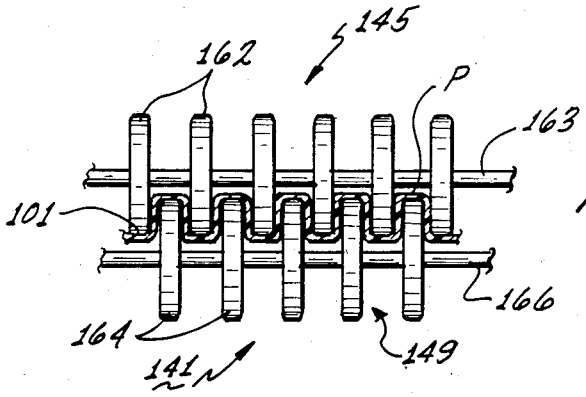
FIG. 11 is a schematic front elevational sectional view of the device of FIG. 9 taken substantially on line 11—11 thereof.
Figure 9:
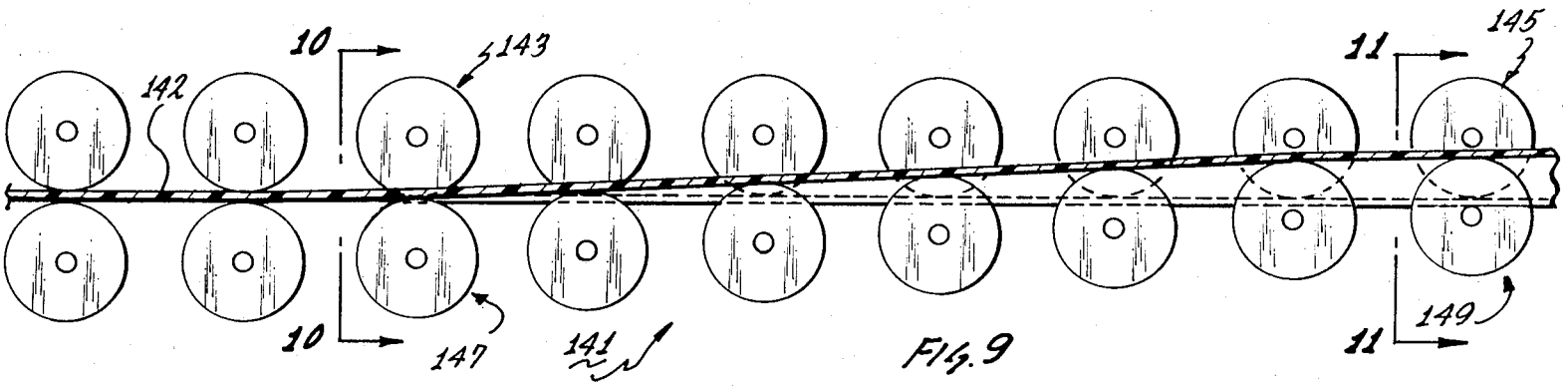
FIG. 9 is a partially schematic side elevational view of a further projection forming device operating according to the method of the present invention illustrated in FIG. 1, and constructed according to the present invention.
Figure 10:
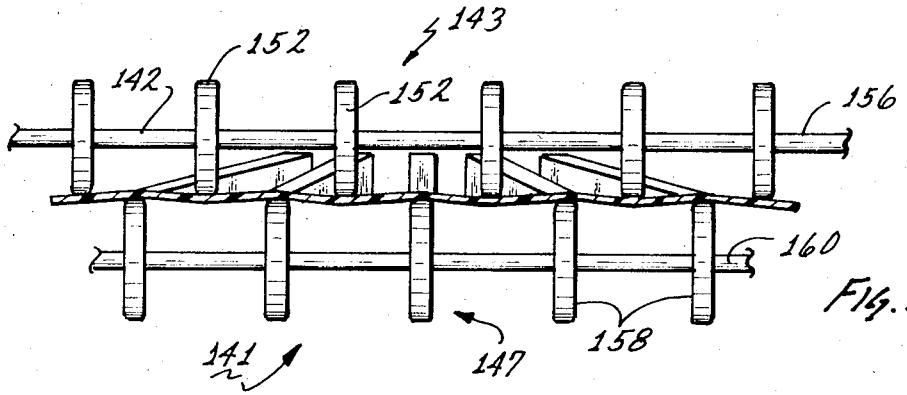
FIG. 10 is a partially schematic front elevational sectional view of the device of FIG. 9 taken substantially on line 10—10 thereof.

Referring now to FIGS. 9, 10 and 11, there is shown a projection forming manufacturing device 141, which is also constructed in accordance with the present invention, and which also enables diaphragm projections to be formed in a continuous-web blank stock 142 according to the method illustrated in FIG. 1. In this regard, the device 141 could be used in place of the device 23 of FIGS. 2 and 3.

As shown in FIG. 9, the device 141 generally comprises a series of longitudinally spaced-apart rows of rollers, such as the upper row of rollers 143 and 145. Similarly, below the web of blank stock 142, there is disposed a series of rows of longitudinally spaced-apart upper rows of rollers, such as the lower rows 147 and 149, disposed below corresponding ones of the upper rows of rollers, such as the respective upper rollers 143 and 145.

As best seen in FIGS. 10 and 11 of the drawings, each row of upper and lower rollers comprise a series of transversely spaced-apart rollers, and the lower rollers are each interleaved with the upper rollers. The lower rollers are disposed progressively upwardly relative to the upper rollers in the direction of travel of the blank stock, to cause the formation of the desired projections, by causing the lower rollers to press the blank stock upwardly between pairs of the upper rollers. As shown in FIG. 10, the blank stock is fed between the upper and lower rollers and the projections have only commenced to be formed. In FIG. 11, the final rollers have completed the formation of the projections.

Considering now the upper rollers 143 as shown in FIG. 10, the upper rollers 143 include a series of spaced-apart rollers 152. There is one more upper roller than the number of projections to be formed. In the present example, five projections are formed, therefore there are six upper rollers provided, and there is one lower roller for each projection. In this regard, the projections are formed in the spaces between the six upper rollers.

A common axle 156 extends transversely above the blank stock 142 for rollably supporting the upper rollers. The lower rollers are mounted on the axle 160 below the blank in a spaced-apart manner.

Referring now to FIG. 11, the upper rollers 145 are mounted in a spaced-apart manner on a common axle 163 above the blank stock 142. The set of lower spaced-apart rollers 164 are mounted on a lower common axle 166 below the blank stock. The lower rollers are interleaved with the upper rollers, and are positioned in close proximity to the roller 163 to form the projections P in the blank stock 101.

While particular embodiments of the present invention have been disclosed, it is to be understood that various different modifications are possible and are contemplated within the true spirit and scope of the appended claims. For example, various different types and kinds of materials can be employed for the various parts, such as the bars and rollers for the mechanisms described previously. There is no intention, therefore, of limitations to the exact abstract or disclosure herein presented.

I claim:

1. A method of making a transducer diaphragm comprising:

using a generally flat stock having a conductive means arranged on at least one face thereof with a series of parallel spaced-apart portions;

pressing on said film on the front face thereof at spaced-apart areas to deform it progressively into a series of substantially U-shaped projections disposed between said areas, each projection having at least one of said portions of said conductive means on the tip portion thereof; and causing said projections to move into close proximity to one another in a parallel manner as said projections are being formed.

2. A method according to claim 1, wherein said pushing includes guiding said film transversely into a group of spaced-apart forming rollers arranged with said groups being spaced apart in the transverse direction of movement of said stock, the rollers of each group being spaced closer together in the direction of movement.

3. A method according to claim 1, wherein said pressing includes moving spaced-apart first members into engagement with the front face of said stock and positioning spaced-apart second members on the rear face of said stock staggered relative to said first members to be interleaved therewith.

4. A method according to claim 2, further including moving said stock along a path of travel and forming said projections as the stock moves along said path.

5. A method according to claim 3, wherein said members are moved into engagement with said stock transversely to the path of travel thereof.

6. A method according to claim 3, further including moving a third set of members into engagement with said front face of said stock opposite the first-mentioned members on the said rear face to clamp said film therebetween.

7. A method according to claim 6, further including moving pairs of said first bars together as said second bars move rearwardly therebetween to form the projections therebetween.

* * * * *